US008135165B2

(12) United States Patent
Hatanaka

(10) Patent No.: US 8,135,165 B2
(45) Date of Patent: Mar. 13, 2012

(54) DIAPHRAGM AND LOUDSPEAKER UNIT USING THE SAME

(75) Inventor: Yuki Hatanaka, Osaka (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 1258 days.

(21) Appl. No.: 11/815,378

(22) PCT Filed: Jan. 27, 2006

(86) PCT No.: PCT/JP2006/301279

§ 371 (c)(1), (2), (4) Date: Aug. 2, 2007

(87) PCT Pub. No.: WO2006/082754

PCT Pub. Date: Aug. 10, 2006

(65) Prior Publication Data

US 2009/0052726 A1 Feb. 26, 2009

(30) Foreign Application Priority Data

Feb. 2, 2005 (JP) ..... 2005-026864

(51) Int. Cl.
*H04R 11/02* (2006.01)

(52) U.S. Cl. ..... 381/431; 181/171

(58) Field of Classification Search ..... 381/431; 181/171

See application file for complete search history.

(56) References Cited

U.S. PATENT DOCUMENTS

| | | | | |
|---|---|---|---|---|
| 6,154,556 | A * | 11/2000 | Takahashi et al. | 381/430 |
| 7,158,650 | B2 | 1/2007 | Furuya et al. | |
| 2003/0079936 | A1 * | 5/2003 | Kuze et al. | 181/171 |
| 2004/0161125 | A1 | 8/2004 | Furuya et al. | |

FOREIGN PATENT DOCUMENTS

| | | | |
|---|---|---|---|
| CN | 1222049 | A | 7/1999 |
| CN | 1527638 | A | 9/2004 |
| JP | 59169189 | U | 11/1984 |
| JP | 3213100 | A | 9/1991 |
| JP | 746690 | A | 2/1995 |
| JP | 2000278790 | A | 10/2000 |
| JP | 200337895 | A | 2/2003 |
| JP | 2003264890 | A | 9/2003 |
| JP | 2004253852 | A | 9/2004 |
| JP | 200526920 | A | 1/2005 |

OTHER PUBLICATIONS

Chinese Office Action dated Jan. 12, 2011, issued in corresponding Chinese Patent Application No. 200680001450.6.

International Search Report of PCT/JP2006/301279, date of mailing May 16, 2006.

* cited by examiner

*Primary Examiner* — Jianchun Qin

(74) *Attorney, Agent, or Firm* — Westerman, Hattori, Daniels & Adrian, LLP

(57) ABSTRACT

A diaphragm, and a loudspeaker unit using the same, capable of providing better low-tone characteristics than conventional ones. A loudspeaker unit includes a base frame and a cover plate joined to each other to provide a flat casing. Arranged in the casing are a diaphragm and a drive mechanism for vibrating the diaphragm. The diaphragm consists of a rectangular area and a pair of semi-elliptic areas, spreading rightward and leftward from the rectangular area, and has an elliptic central portion having its major axis in the longitudinal direction of the diaphragm and a peripheral portion spreading around the central portion. The central portion includes an adhesive layer for fixing a coil, laid on a central area of a diaphragm body, and is formed thicker than the peripheral portion.

5 Claims, 8 Drawing Sheets

DIAPHRAGM AND LOUDSPEAKER UNIT USING THE SAME

TECHNICAL FIELD

The present invention relates to loudspeaker units to be incorporated into small electronic devices such as portable telephones or digital cameras, and to diaphragms for use therein.

BACKGROUND ART

Such loudspeaker units conventionally developed includes a loudspeaker unit including a so-called track-shaped diaphragm 5, as shown in FIG. 13, having an aspect ratio of more than one, and consisting of a rectangular area 5*a* and a pair of semicircular areas 5*b*, 5*b* spreading on right and left of the rectangular area 5*a* (see Patent Document 1).

As shown in FIG. 12, the loudspeaker unit 4 includes a base frame 41 and a cover plate 42. The base frame 41 and the cover plate 42 are joined to each other at respective peripheries to form a flat casing 40.

Arranged in the casing 40 are the track-shaped diaphragm 5 and a drive mechanism 46 for driving the diaphragm 5.

The drive mechanism 46 includes a rectangular magnet 44 placed on the bottom face of the base frame 41, a rectangular toroidal coil 45 surrounding the magnet 44 and fixed to the back face of the diaphragm 5, and a rectangular toroidal metal yoke 43 surrounding the coil 45 and placed on the bottom face of the base frame 41. Application of a driving current to the coil 45 causes the diaphragm 5 to vibrate to produce sound.

As shown in FIG. 13 to FIG. 15, the diaphragm 5 includes a track-shaped thin plate made of a synthetic resin. The longitudinal ends of the diaphragm 5 are each in the form of a semicircle having a diameter equal to the length of the short side of the rectangular area 5*a* of the diaphragm 5.

The diaphragm 5 includes a track-shaped central portion 51 long in the longitudinal direction of the diaphragm 5, and a peripheral portion 52 with a track-shaped contour spreading around the central portion 51. The central portion 51 is formed with a certain or more thickness necessary to keep the strength of the diaphragm 5. The peripheral portion 52 is formed thinner than the central portion 51. The coil 45 is fixed within the central portion 51. The longitudinal ends of the central portion 51 are each in the form of a semicircle having a diameter approximately equal to the length of the short side of the coil 45.

A metal ring member 53 is joined to the peripheral portion 52 of the diaphragm 5 along the outer circumferential edge of the peripheral portion 52. The ring member 53 is pinched between the base frame 41 and the cover plate 42 as shown in FIG. 12.

In order to improve the loudspeaker characteristics, in particular, low-tone characteristics of the loudspeaker unit 4, it is necessary to decrease the area of the thicker formed central portion 51, and to increase the area of the peripheral portion 52, which greatly contributes to improvement in the low-tone characteristics.

A possible approach to decrease the area of the central portion 51 is to miniaturize the coil 45. However, with the configuration of the above loudspeaker unit 4, miniaturization of the coil 45 also brings the necessity of miniaturization of the magnet 44 placed inside the coil 45, which may cause a problem of low magnetic flux density passing through the coil 45, leading to low sound pressure.

Accordingly, in order to improve the low-tone characteristics, there has been proposed a loudspeaker unit 7, as shown in FIG. 16, having a magnet 22 disposed outside a coil 21.

The loudspeaker unit 7 includes a base frame 11 and a cover plate 12. The base frame 11 and the cover plate 12 are joined to each other at respective peripheries to form a flat casing 10.

Arranged in the casing 10 are a track-shaped diaphragm 6 and a drive mechanism 2 for driving the diaphragm 6.

The drive mechanism 2 includes a circular toroidal coil 21 fixed to the diaphragm 6, a circular toroidal magnet 22 surrounding the coil 21 and placed on the bottom face of the base frame 11, and a metal bottom plate 23 placed on the bottom face of the base frame 11. A cylindrical portion 24 projects from the bottom plate 23 toward the internal space of the coil 21.

As shown in FIG. 17 to FIG. 19, the diaphragm 6 includes a track-shaped thin plate made of a synthetic resin. The longitudinal ends of the diaphragm 6 are in the form of a semicircle having a diameter equal to the length of the short axis of the diaphragm 6.

The diaphragm 6 includes a track-shaped central portion 61 long in the longitudinal direction of the diaphragm 6, and a peripheral portion 62 spreading around the central portion 61. The central portion 61 is formed with a certain or more thickness necessary to keep the strength of the diaphragm 6. The peripheral portion 62 is formed thinner than the central portion 61. The coil 21 is fixed within the central portion 61. The longitudinal ends of the central portion 61 are in the form of a semicircle having a diameter approximately equal to the outer diameter of the coil 21.

A metal ring member 63 is joined to the peripheral portion 62 of the diaphragm 6 along the outer circumferential edge of the peripheral portion 62. The ring member 63 is pinched between the base frame 11 and the cover plate 12 as shown in FIG. 16.

The above loudspeaker unit 7 can provide improved low-tone characteristics because the coil 21 is miniaturized to decrease the area of the central portion 61 of the diaphragm 6 shown in FIG. 17 to the minimum that can secure a certain or more strength, and the area of the peripheral portion 62 is enlarged by the decreased area. Low sound pressure can be prevented by the disposition of the magnet 22 sized to secure a certain or more magnetic flux density, as shown in FIG. 16, in the great space created outside the coil 21 by the miniaturization of the coil 21.

Patent Document 1: JP-A-2003-37895 [H04R 9/04]

DISCLOSURE OF THE INVENTION

Problem to be Solved by the Invention

However, the improvement of the low-tone characteristics has been still insufficient even with a loudspeaker unit using the diaphragm 6 shown in FIG. 17, and a further improvement of the low-tone characteristics has been needed.

Accordingly, an object of the present invention is to provide a diaphragm, and a loudspeaker unit using the same, capable of providing better low-tone characteristics than conventional ones.

Means for Solving the Problem

As a result of repeating intensive studies, the present inventor has completed the present invention, investigating, as described below, the cause of failure of the diaphragm 6 shown in FIG. 17 to provide sufficient low-tone characteristics.

With the track-shaped diaphragm 6, vibration characteristics of the diaphragm 6 are greatly affected by the shape of the peripheral portion 62, i.e., the shape of an annular region between the border line with the central portion 61 and the outer circumferential edge. In the conventional track-shaped diaphragm 6, as shown in FIG. 17, the outer circumferential edge of the peripheral portion 62 includes straight line segments, and the border line between the central portion 61 and the peripheral portion 62 also includes straight line segments, with the both straight line segments being parallel to each other. The peripheral portion 62 has therefore a shape on a plane where its width suddenly increases in the middle of the way from a minimum width portion having a minimum width X between the both straight line segments to a maximum width portion having a maximum width Y between two circular arc segments.

When a certain vibration force is applied to the central portion 61 in the diaphragm 6 with the outer circumferential edge of the peripheral portion 62 providing a fixed end, regions of the peripheral portion 62 with a constant or gently varying width allows free vibration because the regions have a relatively high degree of freedom for vibration, and easily deform with the vibration. However, regions of the peripheral portion 62 with a width suddenly varying from the minimum width toward the maximum width inhibits free vibration because the regions have a low degree of freedom for vibration, and do not easily deform with the vibration. This results in failure to provide desired low-tone characteristics.

Accordingly, the present invention provides a diaphragm where the width of its peripheral portion gently varies from the minimum width portion toward the maximum width portion, thereby improving the low-tone characteristics.

A diaphragm of the present invention has orthogonal long and short axes on a plane, and includes a central portion 31 having the intersection of the long and short axes as its center, and a peripheral portion 32 spreading around the central portion 31. The central portion 31 is formed thicker than the peripheral portion 32. The diaphragm vibrates with the outer circumferential edge of the peripheral portion 32 providing a fixed end.

In the diaphragm of the present invention, the peripheral portion 32 is shaped such that its width, radially extending from the intersection, i.e. the distance from the border line between the central portion 31 and the peripheral portion 32 to the outer circumferential edge of the peripheral portion 32, is smallest on the short axis, and largest on the long axis, and such that the width monotonically increases from the minimum width on the short axis to the maximum width on the long axis.

When a certain vibration force is applied to the central portion 31 with the outer circumferential edge of the peripheral portion 32 providing a fixed end, the diaphragm of the present invention has a high degree of freedom for vibration throughout the peripheral portion 32, and easily deforms with the vibration, because the width of the peripheral portion 32 monotonically increases from the minimum width on the short axis to the maximum width on the long axis, and does not suddenly vary in the middle. This results in better low-tone characteristics than those of conventional diaphragms where the width of the peripheral portion suddenly varies from the minimum width portion toward the maximum width portion.

Specifically, the outer circumferential edge of the peripheral portion 32 describes a curve of varying curvature radius at least at each of the opposite ends in the long axis direction, the curve having a minimum curvature radius at the intersection with the long axis, while the border line between the peripheral portion 32 and the central portion 31 describes a curve having a minimum curvature radius at an intersection with the long axis and having a maximum curvature radius at an intersection with the short axis.

Further specifically, the curve described by the outer circumferential edge of the peripheral portion 32 is a part of an ellipse, and the curve described by the border line between the peripheral portion 32 and the central portion 31 is an ellipse.

With this specific configuration, the border line between the peripheral portion 32 and the central portion 31 describes an ellipse having its major axis in the longitudinal direction of the diaphragm, or a curve having a minimum curvature radius at an intersection with the long axis of the diaphragm and having a maximum curvature radius at an intersection with the short axis of the diaphragm. The outer circumferential edge of the peripheral portion 32 describes, at least at each of the longitudinal ends of the diaphragm, a part of an ellipse having its major axis in the longitudinal direction of the diaphragm, or a curve of gradually varying curvature radius having a minimum curvature radius at the intersection with the long axis.

Thus, even if the outer circumferential edge of the peripheral portion 32 includes a straight line segment parallel to the long axis of the diaphragm, the width of the peripheral portion 32 gently increases from the minimum width on the short axis of the diaphragm toward the maximum width on the long axis, because there is no straight line segment on the border line between the peripheral portion 32 and the central portion 31.

When a certain vibration force is applied to the central portion 31 with the outer circumferential edge of the peripheral portion 32 providing a fixed end, the diaphragm of this specific configuration has a high degree of freedom for vibration throughout the peripheral portion 32, and easily deforms with the vibration, because the width of the peripheral portion 32 gently increases from the minimum width on the short axis to the maximum width on the long axis, and does not suddenly vary in the middle. This results in better low-tone characteristics than those of conventional diaphragms where the width of the peripheral portion suddenly varies from the minimum width portion toward the maximum width portion.

A loudspeaker unit of the present invention includes a flat casing 10 containing a diaphragm 3 having orthogonal long and short axes on a plane, and a drive mechanism 2 for vibrating the diaphragm 3. The drive mechanism 2 includes a toroidal coil 21 fixed to the diaphragm 3, a toroidal magnet 22 surrounding the coil 21, and a bottom plate 23 partly projecting into the central space of the coil 21. The diaphragm 3 includes a central portion 31 having the intersection of the long and short axes as its center, and a peripheral portion 32 spreading around the central portion 31. The central portion 31 is formed thicker than the peripheral portion 32. The coil 21 is fixed to the central portion 31. The outer circumferential edge of the peripheral portion 32 is coupled to the casing 10.

The peripheral portion 32 of the diaphragm 3 is shaped such that its width, radially extending from the intersection, is smallest on the short axis, and largest on the long axis, and such that the width monotonically increases from the minimum width on the short axis to the maximum width on the long axis.

Specifically, the outer circumferential edge of the peripheral portion 32 of the diaphragm 3 describes a curve of varying curvature radius at least at each of the opposite ends in the long axis direction, the curve having a minimum curvature radius at the intersection with the long axis, while the border line between the peripheral portion 32 and the central portion 31 describes a curve having a minimum curvature radius at an intersection with the long axis and having a maximum curvature radius at an intersection with the short axis.

Further specifically, the diaphragm 3 includes a rectangular area 30*a* and a pair of semielliptic areas 30*b*, 30*b* spreading from the rectangular area 30*b* to the opposite sides in the long axis direction of the diaphragm 3. The outer circumferential edge of each semielliptic area 30*b* describes an elliptic curve having a minimum curvature radius at the intersection with the long axis, and the border line between the peripheral portion 32 and the central portion 31 describes an elliptic curve having a minimum curvature radius at an intersection with the long axis and having a maximum curvature radius at an intersection with the short axis.

The loudspeaker unit of the present invention includes the above-described diaphragm 3 of the present invention, and consequently exhibits excellent low-tone characteristics, because the diaphragm 3 has a high degree of freedom for vibration throughout the peripheral portion 32, and easily deforms with the vibration.

Use of the small toroidal coil 21 decreases the area of the thick formed central portion 31 of the diaphragm 3 to the minimum that can secure a certain or more strength, and the area of the peripheral portion 62 is enlarged by the decreased area of the central portion 31, thereby further improving the low-tone characteristics.

Further, low sound pressure can be prevented by the disposition of the magnet 22 sized to secure a certain or more magnetic flux density in the great space created outside the coil 21 by the miniaturization of the coil 21.

Specifically, the diaphragm 3 includes an adhesive layer 33 for fixing the coil 21, laid on a central area of a diaphragm body 30. The central area of the diaphragm body 30 and the adhesive layer 33 provides the central portion 31.

With this specific configuration, the thick central portion 31 can be formed in the diaphragm 3 in a simple way by forming the adhesive layer 33 for fixing the coil 21 to the diaphragm body 30 into an ellipse in the process of fixing the coil 21 to the diaphragm body 30.

Effect of the Invention

The diaphragm of the present invention and the loudspeaker unit using the same can provide better low-tone characteristics than conventional ones.

EXPLANATION OF REFERENCE NUMERALS

Figure 1:
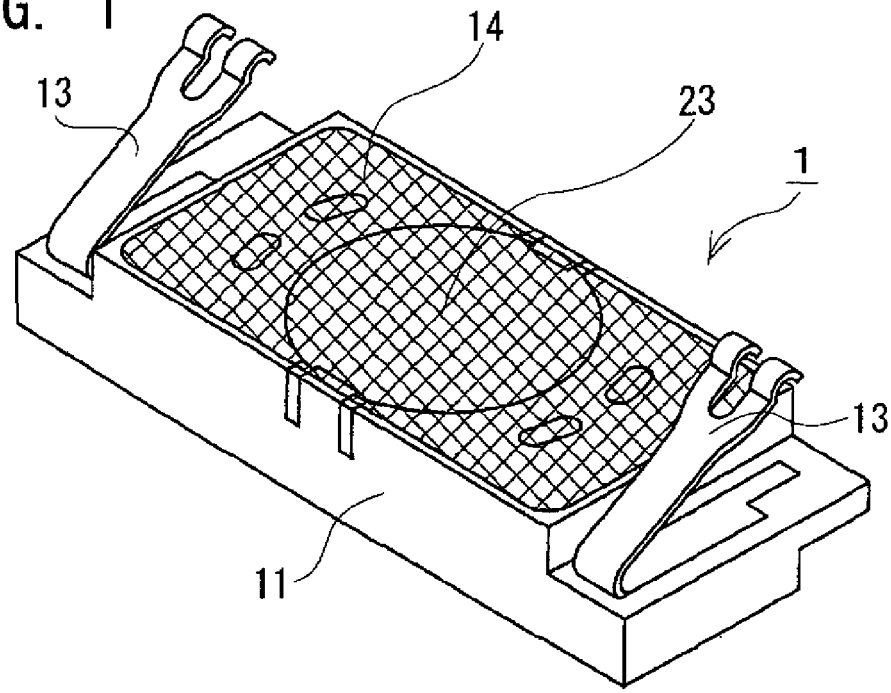
FIG. 1 is a perspective view of a loudspeaker unit of the present invention seen from the back.

1 loudspeaker unit
10 casing
11 base frame
12 cover plate
2 drive mechanism
21 coil
22 magnet
23 bottom plate
3 diaphragm
30 diaphragm body
30*a* rectangular area
30*b* semielliptic area
31 central portion
32 peripheral portion
33 adhesive layer
35 ring member

BEST MODE FOR CARRYING OUT THE INVENTION

An embodiment of the present invention will be specifically described below with reference to the drawings.

Figure 2:
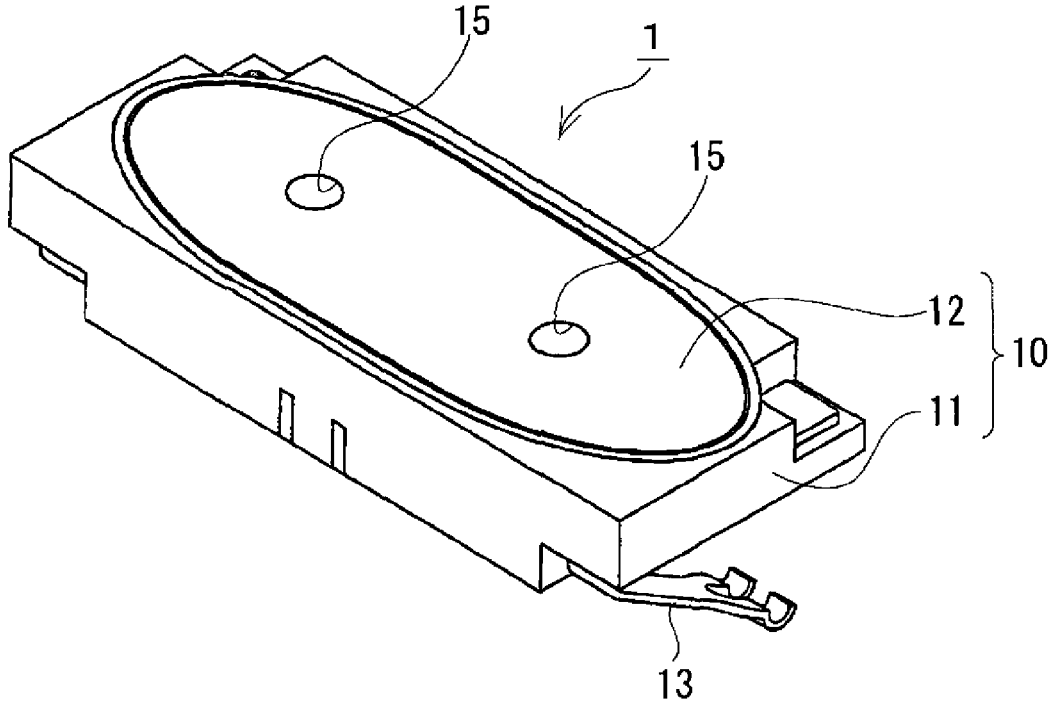
FIG. 2 is a perspective view of the loudspeaker unit seen from the front.

As shown in FIG. 1 and FIG. 2, a loudspeaker unit 1 of the present invention includes a generally rectangular flat base frame 11 long in one direction and made of a synthetic resin, and a track-shaped cover plate 12 made of a sheet metal. The base frame 11 and the cover plate 12 are joined to each other at respective peripheries to form a flat casing 10.

A pair of electrode terminals 13, 13 made of a sheet metal are attached to opposite ends of the base frame 11. A metal bottom plate 23 described below is attached to the bottom face of the base frame 11. The bottom face of the base frame 11 is covered with a sheet 14.

A plurality of through holes 15, 15 for sound emission are provided in the surface of the cover plate 12.

Figure 3:
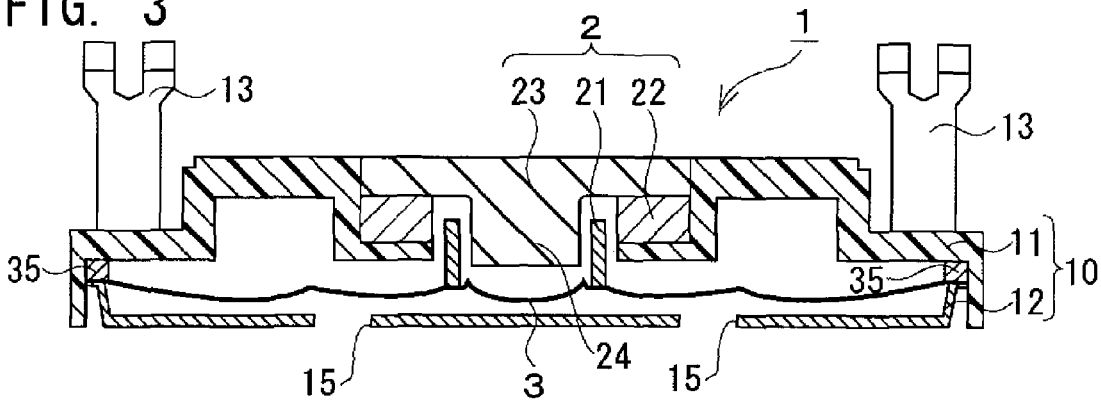
FIG. 3 is a sectional view of the loudspeaker unit.

As shown in FIG. 3, a diaphragm 3 and a drive mechanism 2 for vibrating the diaphragm 3 are arranged in the casing 10. The drive mechanism 2 includes a circular toroidal coil 21 fixed to the back face of the diaphragm 3, a circular toroidal magnet 22 made of a metallic magnet surrounding the coil 21 and placed on the bottom face of the base frame 11, and a metal bottom plate 23 placed on the bottom face of the base frame 11. A cylindrical portion 24 projects from the bottom plate 23 toward the internal space of the coil 21.

Figure 7:
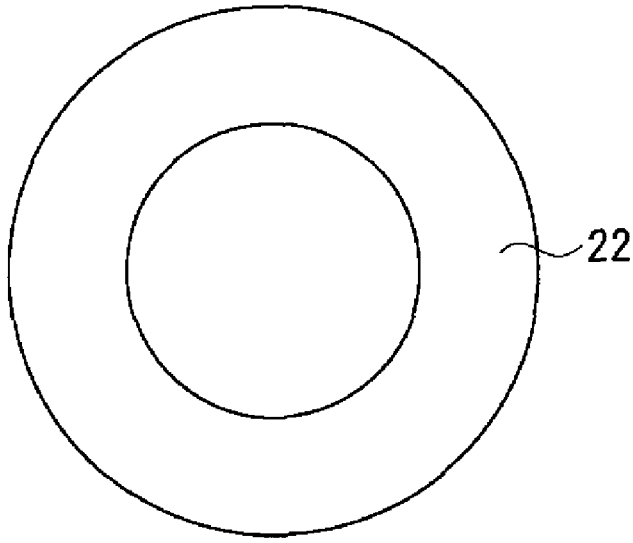
FIG. 7 is a front view of a magnet.
Figure 8:
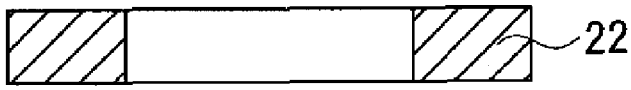
FIG. 8 is a sectional view of the magnet.
Figure 9:
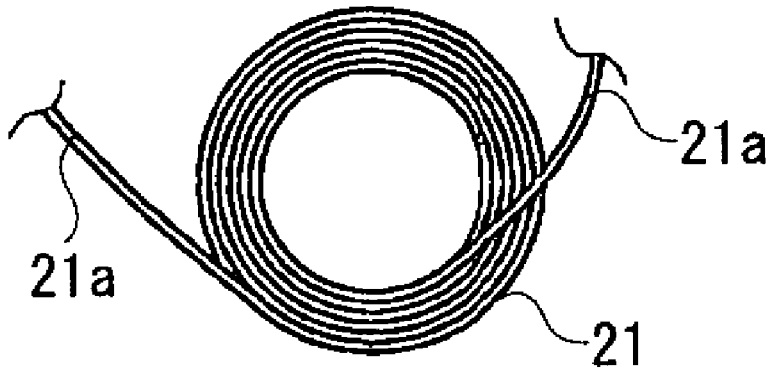
FIG. 9 is a front view of a coil.
Figure 10:
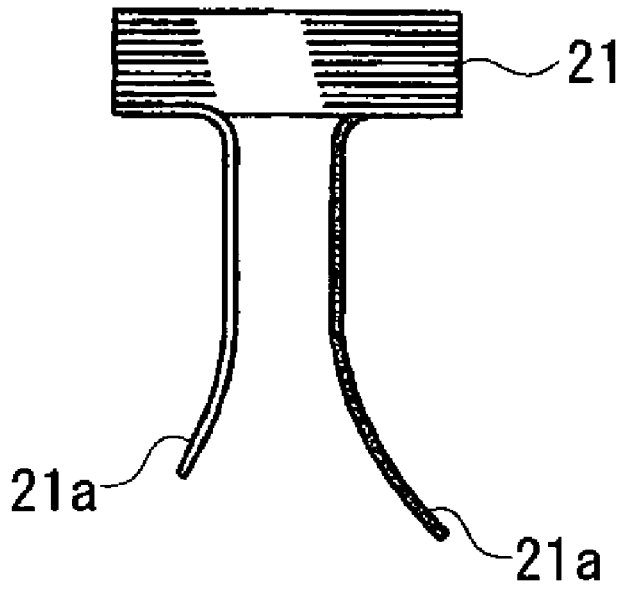
FIG. 10 is a side view of the coil.

As shown in FIG. 9 and FIG. 10, the coil 21 includes a metal conducting wire toroidally wound several turns. A pair of lead wires 21*a*, 21*a*, extending from the opposite ends of the coil 21, are respectively connected to the pair of electrode terminals 13, 13 shown in FIG. 3. Application of a driving current to the coil 44 through the electrode terminals 13, 13 causes the diaphragm 3 to vibrate to produce sound. The coil 21 has an inner diameter of 2.1 mm, an outer diameter of 2.6 mm, and a thickness of 1.1 mm. The magnet 22, shown in FIG. 7 and FIG. 8, has an inner diameter of 3 mm, an outer diameter of 5.4 mm, and a thickness of 0.75 mm.

Figure 4:
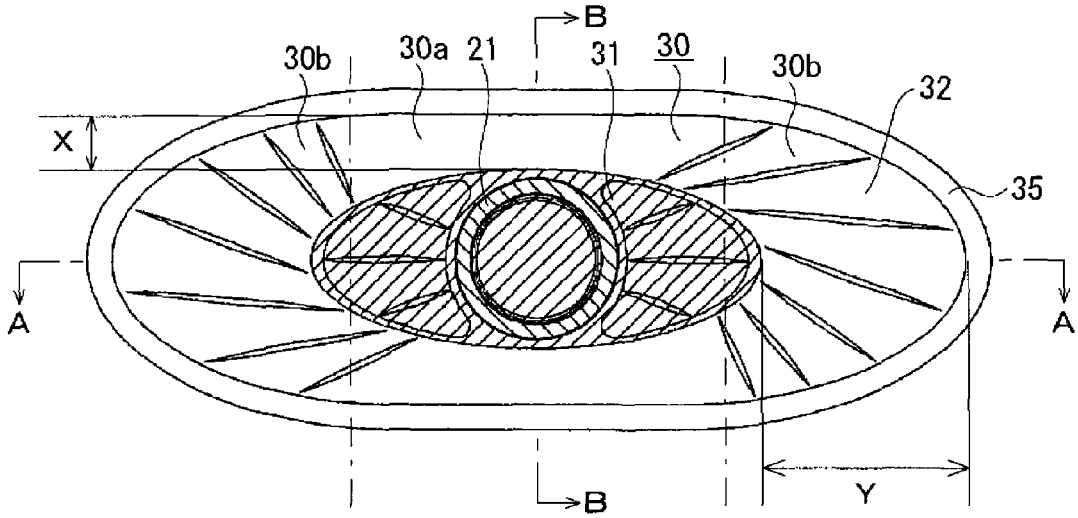
FIG. 4 is a front view of a diaphragm.
Figure 5:
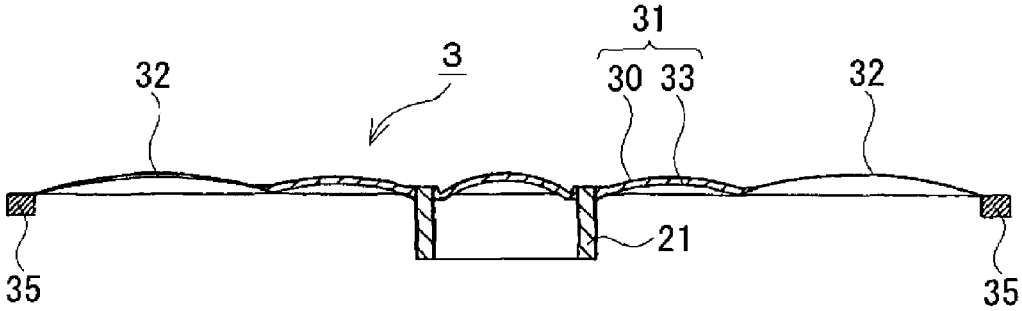
FIG. 5 is a sectional view along the A-A line of FIG. 4.
Figure 6:
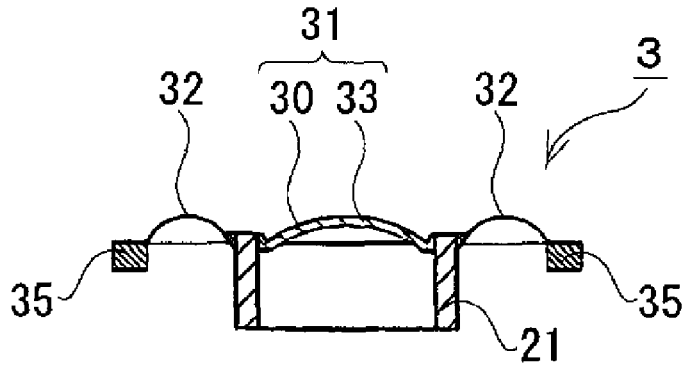
FIG. 6 is a sectional view along the B-B line of FIG. 4.

As shown in FIG. 4 to FIG. 6, the diaphragm 3 includes a diaphragm body 30 made of a synthetic resin having a rectangular area 30*a* and a pair of semielliptic areas 30*b*, 30*b* spreading rightward and leftward from the rectangular area 30*a*.

The rectangular area 30*a* is a rectangle of length 5.5 mm×width 4.5 mm. A semielliptic area 30*b* is in the form of an ellipse with a length of its major axis of 10 mm and a length of its minor axis of 5.5 mm, divided in half by the minor axis. The diaphragm body 30 has a thickness of 10 μm.

The diaphragm 3 includes an elliptic central portion 31 and a peripheral portion 32 spreading around the central portion 31. The central portion 31 includes an adhesive layer 33 for fixing the coil 21, laid on a central area of the diaphragm body 30, and is formed thicker than the peripheral portion 32. A metal ring member 35 is fixed to the peripheral portion 32 along the outer circumferential edge of the diaphragm 3. The ring member 35 is pinched between the base frame 11 and the cover plate 35 as shown in FIG. 3.

The central portion 31 has a length of its major axis of 7.25 mm and a length of its minor axis of 2.9 mm.

In the loudspeaker unit 1 of the present invention, use of the small toroidal coil 21 decreases the area of the thick formed central portion 31 of the diaphragm 3 to the minimum that can secure a certain or more strength, and the area of the peripheral portion 62 is enlarged by the decreased area of the central portion 31, thereby improving the low-tone characteristics.

Further, low sound pressure is prevented by the disposition of the magnet 22 sized to secure a certain or more magnetic flux density in the great space created outside the coil 21 by the miniaturization of the coil 21.

Thus, the loudspeaker unit 1 of the present invention can improve the low-tone characteristics without lowering the sound pressure.

As shown in FIG. 4, the outer circumferential edge of the diaphragm 3 includes a pair of straight line segments defining the outer circumferential edge of the rectangular area 3*a*, and a pair of curve segments defining the outer circumferential edge of the semielliptic areas 3*b*, 3*b*. The border line between the peripheral portion 32 and the central portion 31 describes an ellipse having its major axis in the longitudinal direction of the diaphragm 3. The width of the peripheral portion 32 between the outer circumferential edge of the peripheral portion 32 and the border line with the central portion 31 therefore gently increases from a minimum width position having a minimum width X on the short axis of the diaphragm 3 to a maximum width position having a maximum width Y on the long axis of the diaphragm 3.

As described above, the diaphragm 3 of the loudspeaker unit 1 of the present invention has a shape on a plane where the width of the peripheral portion 31 gently increases from the minimum width to the maximum width, and therefore has a high degree of freedom for vibration throughout the peripheral portion 32, and easily deforms with the vibration, when a certain vibration force is applied to the central portion 31 with the outer circumferential edge of the peripheral portion 32 providing a fixed end. This results in better low-tone characteristics than those of conventional diaphragms where the width of the peripheral portion suddenly varies from the minimum width portion toward the maximum width portion.

In the assembly process for the loudspeaker unit, the thick central portion 31 can be formed in the diaphragm 3 in a simple way by forming the adhesive layer 33 for fixing the coil 21 to the diaphragm body 30 into an ellipse in the process of fixing the coil 21 to the diaphragm body 30. Adjusting the thickness of the adhesive layer 33 here can provide the diaphragm 3 with any strength.

In order to confirm the effect of the present invention, a comparison of the frequency response was made between the loudspeaker unit 1 of the present invention and the conventional loudspeaker unit 4 shown in FIG. 12 to FIG. 15.

For the loudspeaker unit 1 of the present invention, two kinds of loudspeaker units were produced where the thickness of the diaphragm body 30 shown in FIG. 3 was 10 μm and 15 μm.

Figure 11:
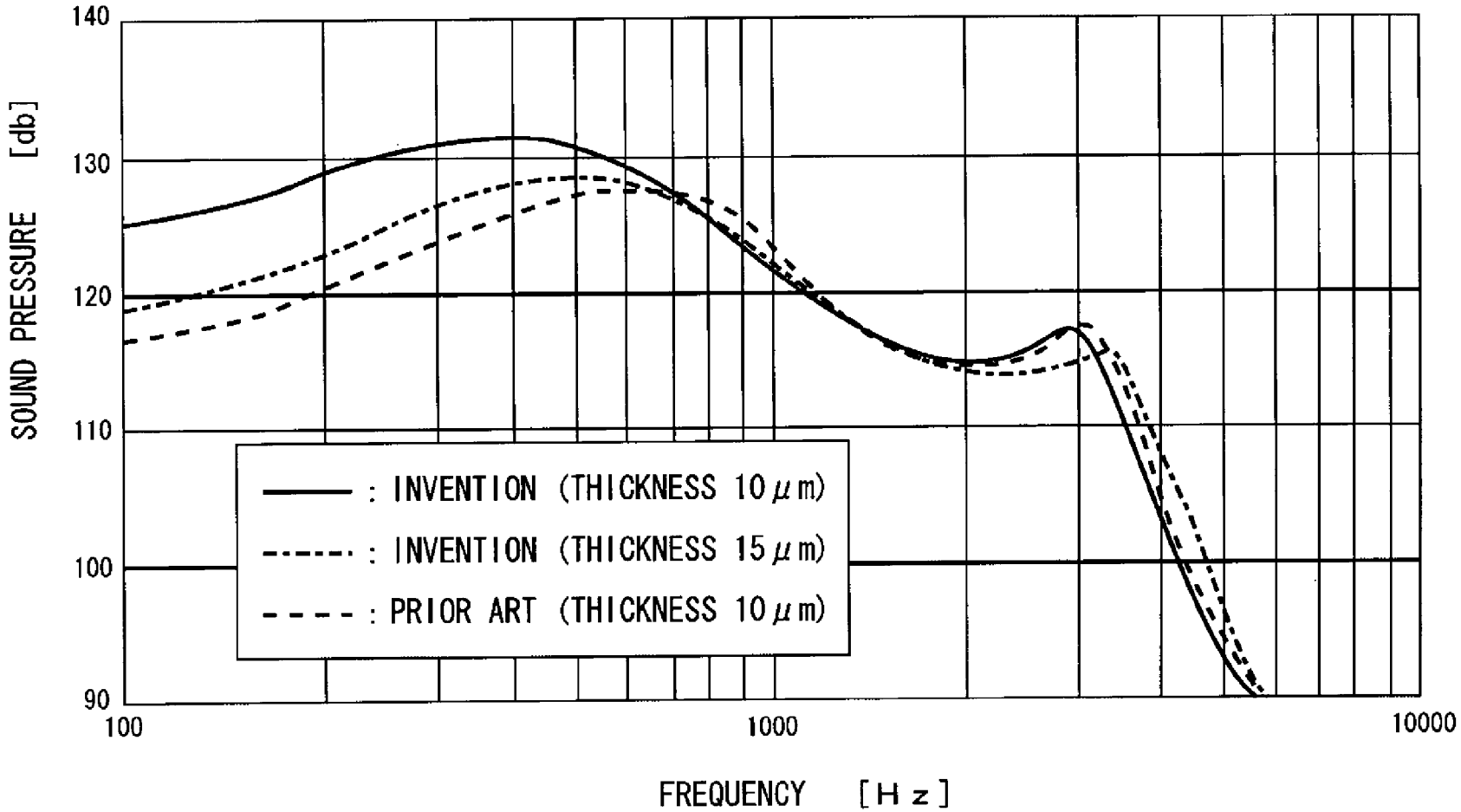
FIG. 11 is a graph where the invention and conventional loudspeaker units are compared in frequency response.
Figure 12:
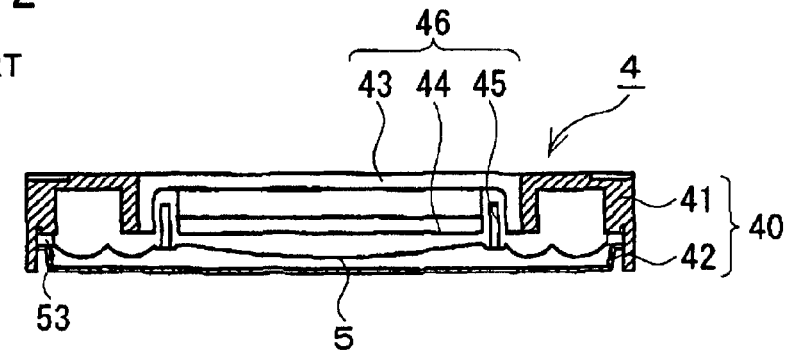
FIG. 12 PRIOR ART
FIG. 12 is a sectional view showing a configuration of a conventional loudspeaker unit.
Figure 13:
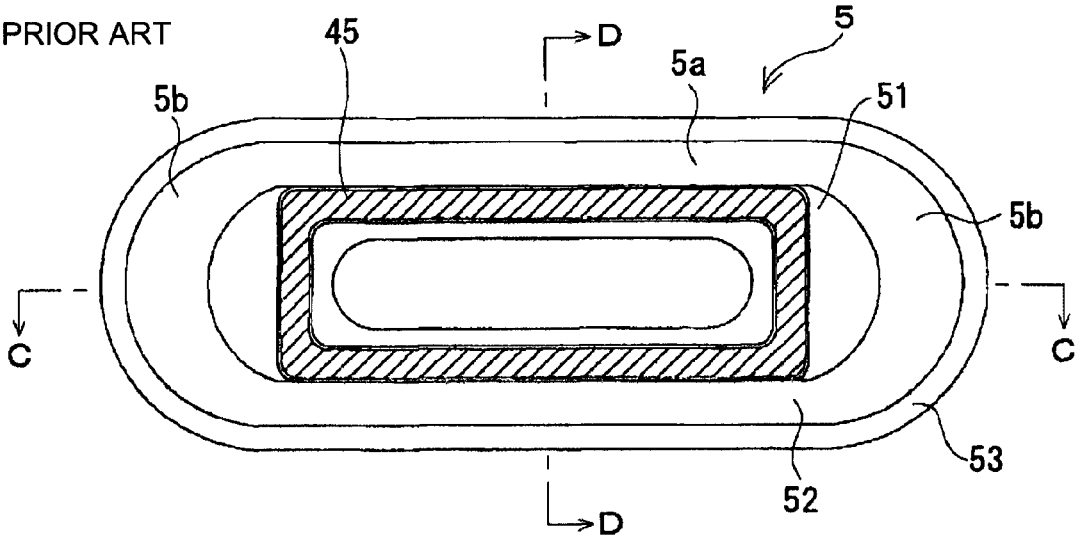
FIG. 13 PRIOR ART
FIG. 13 is a front view of a diaphragm used in the loudspeaker unit.
Figure 14:
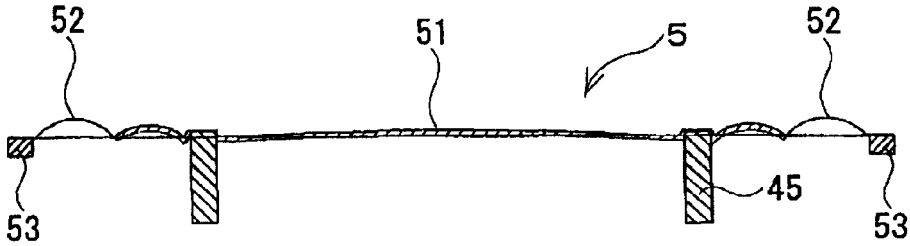
FIG. 14 PRIOR ART
FIG. 14 is a sectional view along the C-C line of FIG. 13.
Figure 15:
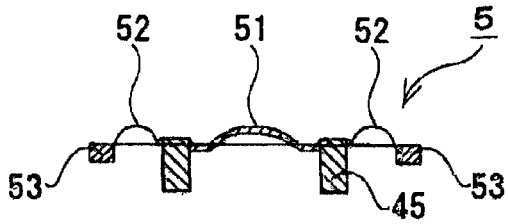
FIG. 15 PRIOR ART
FIG. 15 is a sectional view along the D-D line of FIG. 13.
Figure 16:
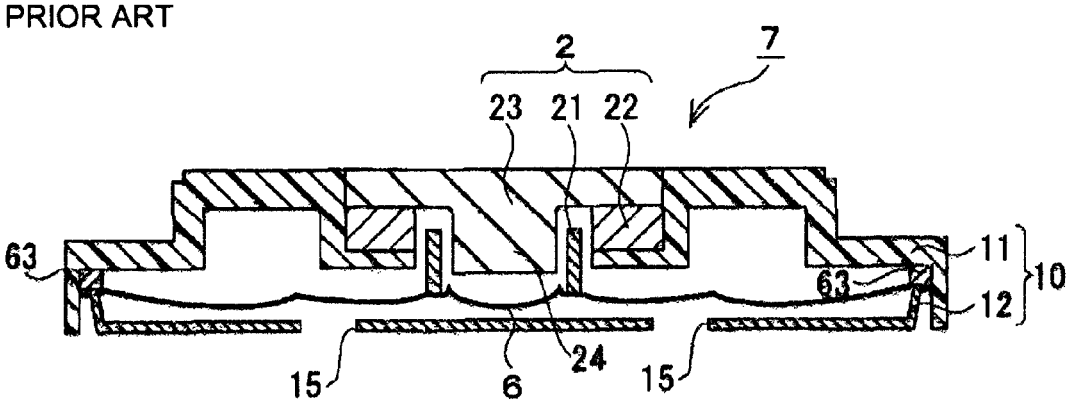
FIG. 16 PRIOR ART
FIG. 16 is a sectional view showing another configuration of a conventional loudspeaker unit.
Figure 17:
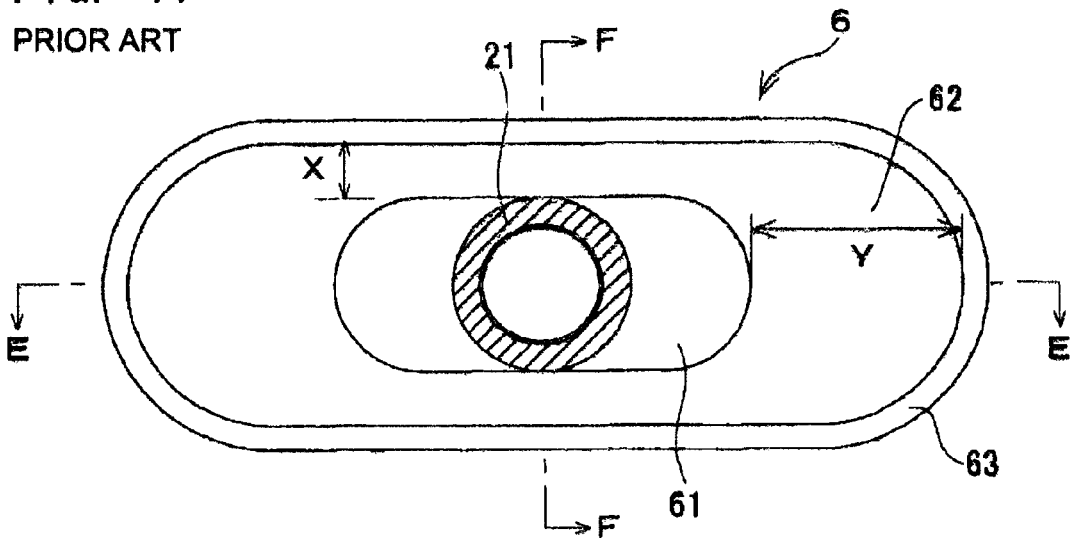
FIG. 17 PRIOR ART
FIG. 17 is a front view of a diaphragm used in the loudspeaker unit.
Figure 18:
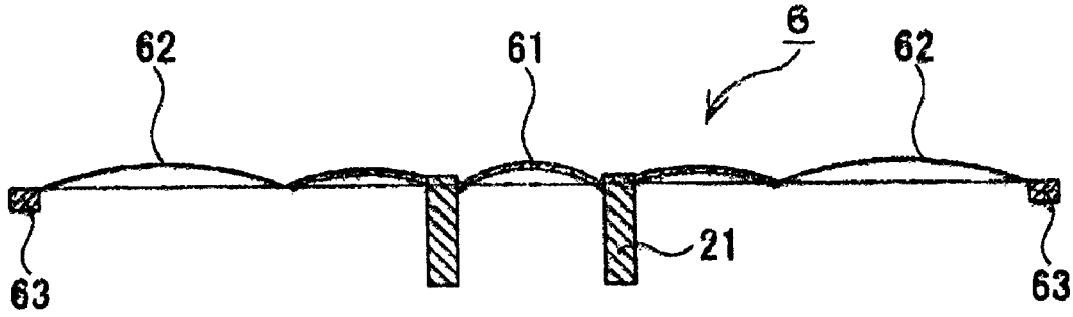
FIG. 18 PRIOR ART
FIG. 18 is a sectional view along the E-E line of FIG. 17.
Figure 19:
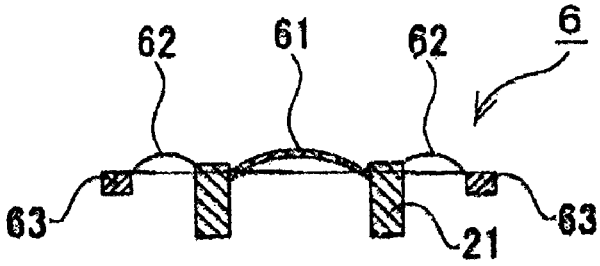
FIG. 19 PRIOR ART
FIG. 19 is a sectional view along the F-F line of FIG. 17.

The conventional loudspeaker unit 4 shown in FIG. 12 was made using a diaphragm 5 of 10 μm thickness, a generally rectangular magnet 44 of width 7.5 mm×length 2 mm, and a generally rectangular toroidal coil 45 with an inside dimension of width 7.9 mm×length 2.4 mm and an outside dimension of width 8.4 mm×length 2.9 mm. FIG. 11 shows the result of a measurement of the frequency response of each loudspeaker unit.

FIG. 11 reveals that although in the high-tone range with a frequency of more than 1,000 Hz, there is no significant difference in frequency response between the loudspeaker units, in the low-tone range with a frequency of 600 Hz or less, the loudspeaker unit 1 of the present invention, regardless of the thickness of the diaphragm, has a higher frequency response than that of the conventional loudspeaker unit 4.

Thus, the loudspeaker unit 1 of the present invention provides excellent low-tone characteristics, not only when the thickness of the diaphragm is equivalent to that of the conventional one, but also when the thickness of the diaphragm is greater than that of the conventional one. This can enhance the strength of the diaphragm without spoiling the low-tone characteristics.

The present invention is not limited to the foregoing embodiment in construction but can be modified variously within the technical scope as set forth in the appended claims. For example, in the present embodiment, the diaphragm body 30 is shaped to consist of a rectangular area 30*a* and a pair of semielliptic areas 30*b*, 30*b* spreading on right and left of the rectangular area 30*a*, but its shape may be elliptic.

The invention claimed is:

1. A diaphragm for a component of a loudspeaker for a small electronic device, the diaphragm comprising:

orthogonal long and short axes on a plane, a central portion having the intersection of the long and short axes as the center thereof, a peripheral portion spreading around the central portion, wherein the central portion being formed thicker than the peripheral portion, the diaphragm is configured to vibrate with an outer circumferential edge of the peripheral portion which has a fixed end, wherein the outer circumferential edge line of the peripheral portion is composed of two first sections each intersecting with the long axis and two second sections each intersecting with the short axis, each of the two first sections describes a curve of varying curvature axis and has a minimum curvature radius at the intersection with the long axis, and each of the two second sections has a straight line in parallel to the long axis, wherein the border line between the peripheral portion and the central portion describes a curve having a minimum curvature radius at an intersection with the long axis and a maximum curvature radius at an intersection with the short axis, and wherein the peripheral portion is shaped such that a width thereof radially extending from the intersection is smallest on the short axis, and largest on the long axis, and the width monotonically increases from a minimum width on the short axis to a maximum width on the long axis.

2. The diaphragm according to claim 1, wherein the curve described by the outer circumferential edge of the peripheral portion is a part of an ellipse, and the curve described by the border line between the peripheral portion and the central portion is an ellipse.

3. A loudspeaker comprising:

a flat casing containing a diaphragm having orthogonal long and short axes on a plane, a drive mechanism for vibrating the diaphragm, the drive mechanism comprising a toroidal coil fixed to the diaphragm, a toroidal magnet surrounding the coil, and a bottom plate partly projecting into the central space of the coil, the diaphragm comprising:

a central portion having an intersection of the long and short axes as a center thereof, and a peripheral portion spreading around the central portion, the central portion being formed thicker than the peripheral portion, the coil being fixed to the central portion 31, the outer circumferential edge of the peripheral portion being coupled to the casing, wherein the outer circumferential edge line of the peripheral portion in the diaphragm is composed of a first two sections each intersecting with the long axis and a second two sections each intersecting with the short axis, each of the first two section describes a curve of varying curvature axis and has a minimum curvature radius at the intersection with the long axis, and each of the second two sections has a straight line in parallel to the long axis, the border line between the peripheral portion and the central portion describes a curve having a minimum curvature radius at an intersection with the long axis and a maximum curvature radius at an intersection with the short axis, wherein the peripheral portion of the diaphragm is shaped such that a width thereof radially extending from the intersection is smallest on the short axis, and largest on the long axis, and the width monotonically increases from the minimum width on the short axis to the maximum width on the long axis.

4. The loudspeaker unit according to claim 3, wherein the diaphragm comprises a rectangular area and a pair of semi-elliptic areas, spreading from the rectangular area to the opposite sides in the long axis direction of the diaphragm, wherein the outer circumferential edge of each semi-elliptic area describes an elliptic curve having a minimum curvature radius at the intersection with the long axis, and the border line between the peripheral portion and the central portion describes an elliptic curve having a minimum curvature radius at an intersection with the long axis and having a maximum curvature radius at an intersection with the short axis.

5. The loudspeaker unit according to claim 3, wherein the diaphragm comprises an adhesive layer for fixing the coil, laid on a central area of a diaphragm body, the central area of the diaphragm body and the adhesive layer providing the central portion.

* * * * *